US005273174A

United States Patent [19]

Fisher

[11] Patent Number: 5,273,174

[45] Date of Patent: Dec. 28, 1993

[54] PIZZA CONTAINER

[76] Inventor: Ronald F. Fisher, 276 Armadale Ave., Toronto, Ontario, Canada, M6S 3X4

[21] Appl. No.: 928,754

[22] Filed: Aug. 13, 1992

[51] Int. Cl.[5] ..... B65D 1/24

[52] U.S. Cl. ..... 220/4.21; 220/315; 220/306; 206/45.32

[58] Field of Search ..... 220/4.21, 4.24, 315, 220/306; 206/45.31

[56] References Cited

U.S. PATENT DOCUMENTS

| | | | |
|---|---|---|---|
| 2,292,819 | 8/1942 | Breese | 220/40 |
| 3,835,281 | 9/1974 | Mannix | 219/10.55 |
| 4,360,118 | 11/1982 | Stern | 220/4 |
| 4,373,636 | 2/1983 | Hoffman | 206/551 |
| 4,705,163 | 11/1987 | James | 206/45.32 |
| 4,848,543 | 7/1989 | Doboze | 206/45.32 |
| 4,886,179 | 12/1989 | Volk | 220/23.4 |

*Primary Examiner*—Joseph Man-Fu Moy
*Attorney, Agent, or Firm*—Shoemaker and Mattare Ltd.

[57] ABSTRACT

Two substantially identical tray members cooperate to define an enclosed space for a pizza pie or the like, each having a circular base wall, a frusto-conical side wall and an annular flange. A rib and groove arrangement in the flanges allows the tray members to remain concentric while mutually rotating between one angulation wherein a locking arrangement is disengaged, and a second angulation in which the locking arrangement is engaged.

17 Claims, 2 Drawing Sheets

PIZZA CONTAINER

This invention relates generally to containers for foodstuffs, and has to do particularly with the construction of a reusable container capable of keeping items like pizza pies both safe and hot during transportation to a delivery spot.

BACKGROUND OF THIS INVENTION

Pizza pies have become a favourite "order in" food material over the past few decades, and many companies, chains and franchises have taken advantage of this lucrative market.

Since pizza pies tend to taste best when hot out of the oven, companies engaged in this market have constantly struggled with the tendency for pizza pies to lose heat and cool down if too much time elapses between removal from the oven and delivery to the customer.

A common container for pizza pies during transport from the oven to the customer is one made of corrugated cardboard. Unfortunately, particularly for the large pizza pies, the typically square cardboard container uses a substantial amount of corrugated material, which is not reusable. These cardboard containers are thus discarded by the customer, adding to landfill requirements, and thus placing a burden on the environment. Further, the manufacture of these cardboard boxes consumes natural resources (trees).

In several jurisdictions, legislation is currently being contemplated to limit the use of landfill.

One approach to resolving the above difficulties would be the provision of a reusable container for pizza pies, thus obviating the necessity to create the box in the first place, and to destroy it after use.

PRIOR ART

The following patents are of interest in connection with the present invention:

U.S. Pat. No. 2,292,819, issued Aug. 11, 1942 to Breese;
U.S. Pat. No. 3,835,281, issued Sep. 10, 1974 to Mannix;
U.S. Pat. No. 4,360,118, issued Nov. 23, 1982 to Stern;
U.S. Pat. No. 4,705,163, issued Nov. 10, 1987 to James;
U.S. Pat. No. 4,373,636, issued Feb. 15, 1983 to Hoffman;
U.S. Pat. No. 4,848,543, issued Jul. 18, 1989 to Doboze;
U.S. Pat. No. 4,886,179, issued Dec. 12, 1989 to Volk.

U.S. Pat. No. 4,360,118, Stern, discloses a pizza pie container consisting of two identical, self-mating dish-like portions with peripheral regions that engage and lock together in a releasable manner. While the device disclosed by Stern functions well enough, it incorporates a particularly complex locking mechanism which is difficult to manufacture and complicated to utilize.

U.S. Pat. No. 4,373,636, Hoffman, provides a tray having ribs for positioning beneath a hot pizza pie to prevent the pizza from becoming soggy. The ribs stiffen the tray and provide airflow passages under the pizza pie.

U.S. Pat. No. 4,848,543, Doboze, discloses a pizza pie container consisting of a top and a bottom which are integrally hinged together, and which employ a Velcro TM or similar engagement means to close the container.

U.S. Pat. No. 3,835,281, Mannix, discloses a container for cooking food, consisting of a top and a bottom which mate together in such a way as to provide grooves to ease internal pressure.

The remaining patents on the above list illustrate the prior art background.

GENERAL DESCRIPTION OF THIS INVENTION

In view of the prior disclosures mentioned above, it is an object of one aspect of this invention to provide a tray member adapted for cooperation with a substantially identical tray member to define an enclosed space for receiving a pizza pie or the like, the tray members being easily moved between a locked configuration and an unlocked configuration.

More particularly, this invention provides a tray member adapted for cooperation with a substantially identical tray member to define an enclosed space adapted to receive a pizza pie comprising:

a base wall portion having a center and a substantially circular circumference, a substantially frusto-conical side wall extending from said circumference to a substantially circular edge, the side wall being substantially concentric with said base wall, a flange extending outwardly from said edge to a flange periphery, said flange having a flange surface directed away from the base wall, groove means in said flange, the groove means being substantially concentric with said base wall and extending around a portion of said flange which is less than the entirety of the flange, protuberant means projecting from said flange at a location substantially opposed to that of said groove means, the protuberant means extending around a portion of the flange which is less than that occupied by said groove means, the protuberant means being substantially concentric with said base wall and adapted to be slidably received within the groove means on a substantially identical such tray member when the tray members are placed with said flange surfaces facing each other, and two locking tab means at substantially opposed locations around the flange, each locking tab means being adapted to interengage with a similar locking tab means on a substantially identical such tray member so that the two tray members may rotate with respect to each other between a first mutual angulation in which the locking tab means are disengaged and a second mutual angulation in which the locking tab means are engaged.

GENERAL DESCRIPTION OF THE DRAWINGS

Two embodiments of this invention are illustrated in the accompanying drawings, in which like numerals denote like parts throughout the several views, and in which.

DETAILED DESCRIPTION OF THE DRAWINGS

Figure 1:
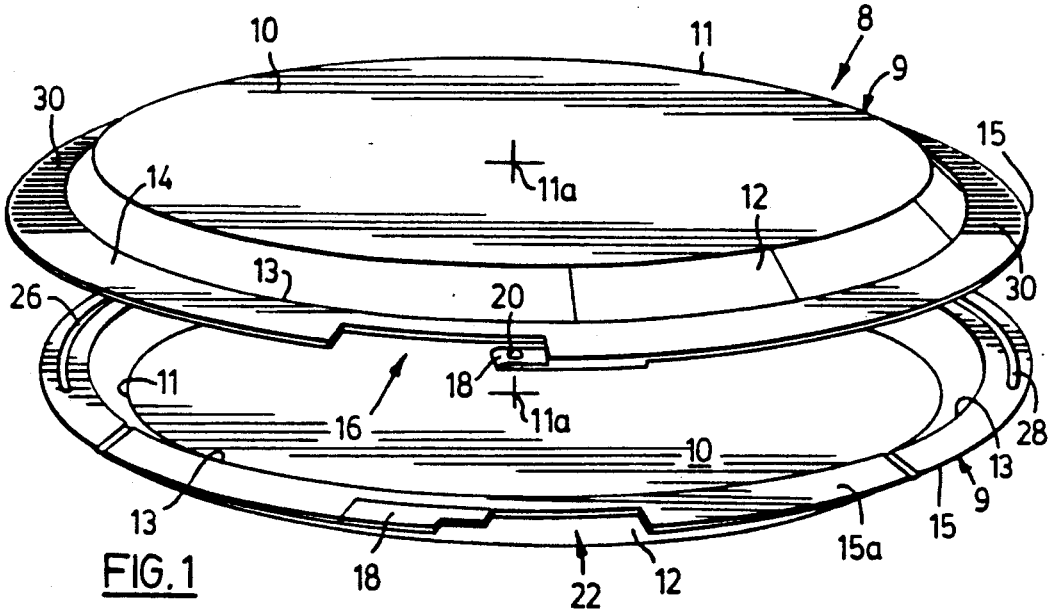
FIG. 1 is a perspective view of two tray members, in separated condition, illustrating a first embodiment of this invention.

Turning first to FIG. 1, there is illustrated a container 8 made of two substantially identical tray members 9, each somewhat in the shape of a pie plate but large enough to contain a typical "large" pizza pie. In FIG. 1, each tray member 9 (constituting half of the container) has a base wall portion 10 having a substantially circular circumference 11 and a center of curvature 11*a*.

The tray member further includes a substantially frusto-conical sloping side wall 12 extending from the circumference 11 to a substantially circular edge 13. Thus, the side wall 12 is substantially concentric with the base wall 10 about the center of curvature 11*a*.

The tray member further incorporates a flange 14 extending outwardly from the edge 13 to a flange periphery 15, the flange 14 having a flange surface 15*a* which is directed away from the base wall 10. Thus, the surface 15*a* of the flange 14 of a tray member is the surface which will be juxtaposed against a like surface of a similar or identical tray member, when defining a container for a pizza pie or similar foodstuff. The flange illustrated is substantially annular, although strict annularity is not essential.

The flange 14 is equipped at one peripheral location with a cut-away portion 16, in association with a flexible tab 18 supporting a protrusion 20. In the preferred embodiment, there is provided at the diametrically opposite point (visible in FIG. 2, but hidden in FIG. 1) a similar cut-away portion 16, with a similar tab 18 supporting a protrusion (in FIG. 2 the protrusions 20 are on the unseen sides of the locking tabs 18). Alternatively, the locking tabs 18 of one of the tray members 8 can be provided with indents or recesses adapted to register with the protrusions 20 of the other tray member.

Figure 2:
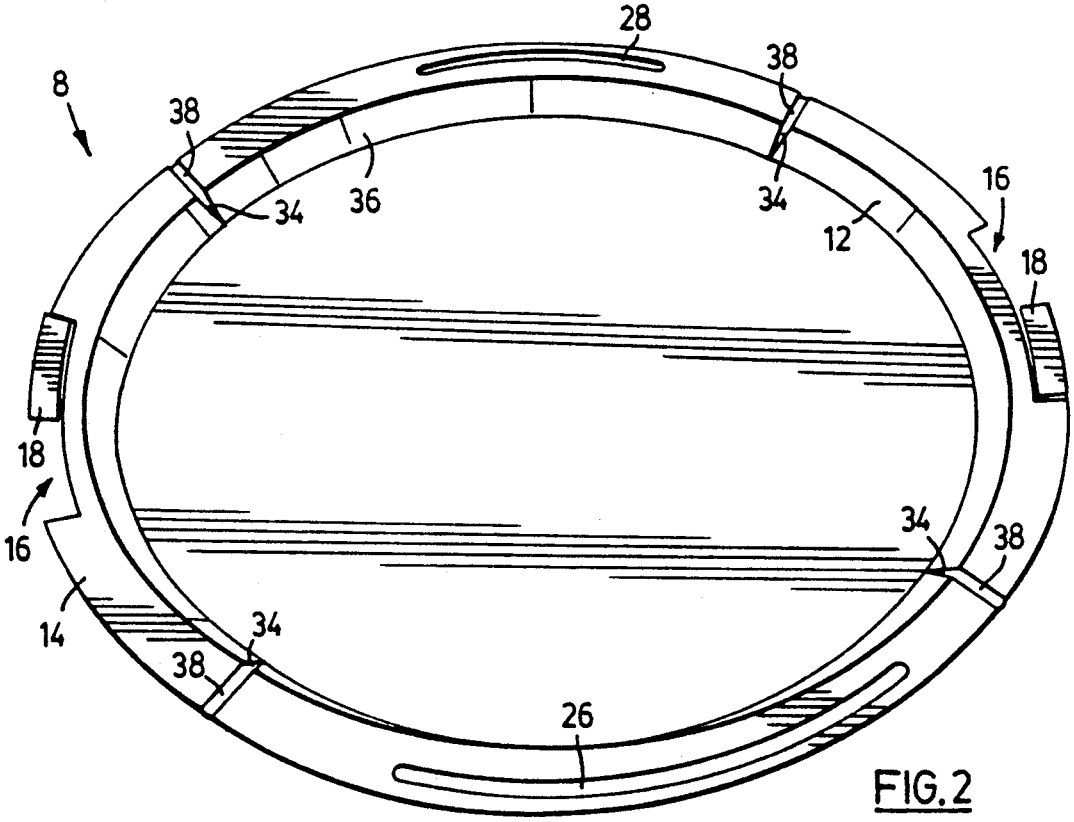
FIG. 2 is a perspective view of the inside of one tray member of the first embodiment.

Groove means are provided in the flange 14 of each tray member, the groove means being substantially concentric with the center of curvature 11*a* of the base wall, and extending around a portion of the flange 14. More specifically, FIG. 2 shows a groove 26 which is concentric with the base wall 10. In a non-limiting example, the groove 26 may subtend at the circular center 11*a* of the base wall 10 an angle lying between about 25° and about 40°.

Also clearly seen in FIG. 2 is a protuberant means in the form of a continuous rib 28 which, in the embodiment illustrated, is located diametrically opposite the groove 26. The protuberant rib extends around a portion of the flange 14 which is less than that occupied by the groove 26, thus making it possible for the rib 28 to be slidably received within the groove 26 on a substantially identical such tray member, when the tray members are placed with the flange surfaces 15*a* facing each other.

It will thus be appreciated that the cooperation between the grooves 26 and the ribs 28 on two substantially identical tray members 8 promotes proper tracking of one tray member with respect to the other when one tray member is rotated with respect to the other.

It will now be understood that the locking tabs 18 on two cooperating tray members 8 are adapted to be disengaged when the tray members 8 take up a first mutual angulation, and engage one another when the two tray members are in a second mutual angulation.

It is to be noted that the individual locking tabs 18 are offset from the planes of their respective flanges 14, this being required in the specific embodiment illustrated to prevent mechanical interference between the tabs when they approach their "locked" orientation.

Each tray member 8 has, on the surface which is opposite the flange surface 15*a*, a surface irregularity 30 for engagement by the thumb or fingers, thus facilitating rotation of one tray member 8 with respect to another. In the embodiment illustrated in FIG. 1, the irregularity 30 is constituted by radially extending grooves. It will be understood, however, that any pattern which applies a gripping tread on the required surface will suffice. Generally speaking, the finger grip irregularity 30 corresponds to the positions of the groove 26 and the rib 28, due to the fact that it is these portions that need to be held in registry to keep the rib tracking in the groove, and thus maintain concentricity between the two tray members 8.

As seen in FIG. 2, each tray member 8 is provided with vent channels 34 on the frusto-conical wall 12, with aligned grooves 38 in the surface 15*a* of the flange 14. The vent channels 34 facilitate the drying of tray members that are stacked in a damped condition, thus preventing growth of bacteria. The vent channels 34 also facilitate the separation of individual trays from a stack of trays by eliminating the formation of a vacuum between two adjacent trays. The grooves 38 provide means for relieving pressure within the compartment defined between two juxtaposed tray members 8, and also allow the escape of steam in order to promote crispiness.

Figure 3:
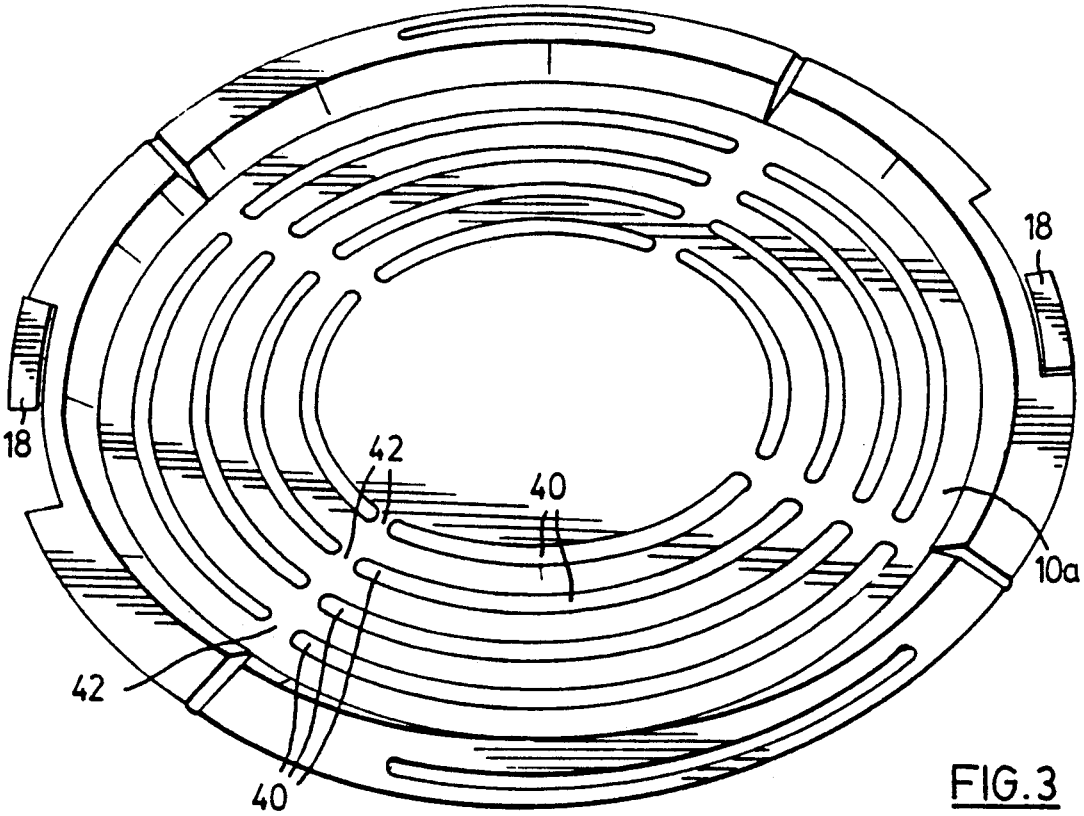
FIG. 3 is a perspective view of the inside of a second embodiment of a tray member in accordance with this invention.
Figure 4:
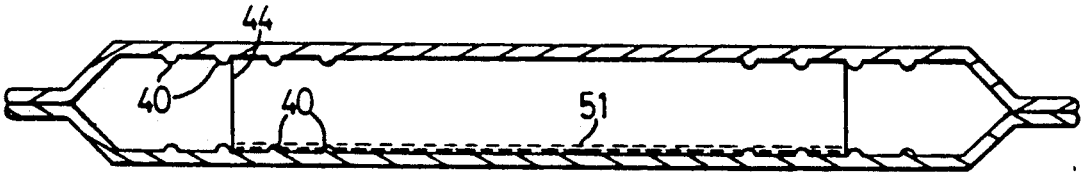
FIG. 4 is an axial sectional view through a container composed of two tray members of the second embodiment, having the construction shown in FIG. 3.

Attention is now directed to FIGS. 3 and 4, illustrating the second embodiment. In these figures, the base wall 10*a* is provided with a plurality of upstanding ribs 40. More specifically, in FIG. 3 it can be clearly seen that the ribs 40 all extend circularly and concentrically with the base wall 10*a*. Still more particularly, the ribs 40 in FIG. 3 are arranged in a plurality of interrupted concentric circles, such that the interruptions 42 permit venting. Moreover, as can be understood by comparing FIGS. 3 and 4, each concentric rib circle is adapted to enclose a cylindrical spacer 44 which can be of a size slightly greater than one of the standard pizza pie sizes. For example the innermost rib circle could correspond to an 8 inch diameter pizza pie, while the next outward concentric rib circle could correspond to a 10 inch diameter pizza pie, and so on.

It will be evident that the ribs 40, in addition to establishing the position of a spacer 44, will function to allow air to circulate under a pizza to maintain crispiness. Additionally, the ribs 40 serve to insulate the pizza by preventing heat dissipation to the outside surface when the pizza is in direct contact with the inside bottom surface of one of the tray members 8.

A variant of this invention is illustrated in FIG. 4, where broken lines 51 illustrate the optional provision of a thin "bottom" wall, optionally vented, attached to the cylindrical spacer 44, thus defining an upwardly open container which could be removed and given to the customer along with the pizza, whereby the person delivering the pizza could take the two larger trays back with him. As particularly shown in FIG. 4, the bottom wall 51 is secured to the cylindrical spacer 44 a location above the bottom edge of the cylindrical spacer, thus allowing the space required for those of the upstanding ribs 40 which are located within the circle described by the cylindrical spacer 44. If desired, the container defined by the spacer 44 and the bottom wall 51 could be made of disposable and/or bio-degradable material.

Further, it should be understood that the flange 14 could be shaped in such a way (by removing material at diametrically opposed locations) that it can be fitted easily into a small oven.

The combination of the friction-promoting irregularity 30 with the bayonet-joint arrangement of the locking tabs 18, and the tracking effect of registering the rib 28 of one tray member 8 in a corresponding groove 26 of another tray member, provides an efficient, easily manipulated and secure container for pizza pies and the like, consisting of two identical or nearly identical tray members.

While two embodiments of this invention have been illustrated in the accompanying drawings and described hereinabove, it will be evident to those skilled in the art that changes and modifications may be made therein, without departing from the essence of this invention, as set forth in the appended claims.

The embodiments of the invention in which an exclusive property or privilege is claimed are defined as follows:

1. A tray member adapted for cooperation with a substantially identical tray member to define an enclosed space adapted to receive a pizza pie, comprising:

a base wall portion having a center an a substantially circular circumference, a substantially frusto-conical side wall extending from said circumference to a substantially circular edge, the side wall being substantially concentric with said base wall, a flange extending outwardly from said edge to a flange periphery, said flange having a flange surface directed away from the base wall, groove means in said flange, the groove means being substantially concentric with said base wall and extending around a portion of said flange which is less than the entirety of the flange, protuberant means projecting from said flange at a location substantially opposed to that of said groove means, the protuberant means extending around a portion of the flange which is less than that occupied by said groove means, the protuberant means being substantially concentric with said base wall and adapted to be slidably received within the groove means on a substantially identical such tray member when the tray members are placed with said flange surfaces facing each other, and two locking tab means at substantially opposed locations around the flange, each locking tab means being adapted to interengage with a similar locking tab means on a substantially identical such tray member so that the two tray members may rotate with respect to each other between a first mutual angulation in which the locking tab means are engaged.

2. The tray member claimed in claim 1, in which said groove means subtends at the circular center of the base wall an angle lying between about 50 degrees and about 80 degrees, in which said protuberant means is a continuous rib, and in which said protuberant means subtends at the circular center of the base wall an angle lying between about 25 degrees and about 40 degrees.

3. The tray member claimed in claim 1, in which each locking tab means includes an inward recess in the flange periphery and a tab member which is offset from the plane of the flange, the recess being sized to receive the tab member of a locking tab means on a substantially identical such tray member when the two tray members are in said first mutual angulation, said tab member having detent means such that two juxtaposed tab members interlock when the tray members are in said second mutual angulation.

4. The tray member claimed in claim 1, in which the flange is annular and has at least one vent groove extending across it from said edge to said periphery, thus providing means for relieving pressure, and at least one vent channel on the frusto-conical side wall to facilitate nested stacking.

5. The tray member claimed in claim 1, in which the surface which is opposite said flange surface has an irregularity for engagement by the thumb or fingers, thus facilitating rotation of one tray member with respect to another between said first and second mutual angulations.

6. The tray member claimed in claim 1, in which the base wall portion has a plurality of upstanding ribs.

7. The tray member claimed in claim 6, in which the ribs of the base wall extend circularly and concentric with said base wall.

8. The tray member claimed in claim 6 in which the ribs of the base wall are arranged in a plurality of interrupted concentric circles, the interruptions permitting venting, each concentric rib circle being adapted to enclose a cylindrical spacer of a size slightly greater than one of the standard pizza pie sizes.

9. The tray member claimed in claim 2, in which each locking tab means includes an inward recess in the flange periphery and a tab member which is offset from the plane of the flange, the recess being sized to receive the tab member of a locking tab means on a substantially identical such tray member when the two tray members are in said first mutual angulation, said tab member having detent means such that two juxtaposed tab members interlock when the tray members are in said second mutual angulation.

10. The tray member claimed in claim 9, in which the flange has at least one vent groove extending across it from said edge to said periphery, thus providing means for relieving pressure, and at least one vent channel on the frusto-conical side wall to facilitate nested stacking.

11. The tray member claimed in claim 10, in which the surface which is opposite said flange surface has an irregularity for engagement by the thumb or fingers, thus facilitating rotation of one tray member with respect to another between said first and second mutual angulations.

12. The tray member claimed in claim 11, in which the base wall portion has a plurality of upstanding ribs.

13. The tray member claimed in claim 12, in which the ribs of the base wall extend circularly and concentrically with said base wall.

14. The tray member claimed in claim 12, in which the ribs of the base wall are arranged in a plurality of interrupted concentric circles, the interruptions permitting venting, each concentric rib circle being adapted to enclose a cylindrical spacer of a size slightly greater than one of the standard pizza pie sizes.

15. A pizza pie container comprising two tray members, each as claimed in claim 1.

16. The tray member claimed in claim 14, in combination with a plurality of cylindrical spacers, each adapted to be received within concentric rib circles.

17. The tray member claimed in claim 16, in which each cylindrical spacer is vented and has attached thereto a circular bottom wall, thus defining a container adapted to hold a pizza pie.

* * * * *